US011533958B1

(12) United States Patent
Spinnato et al.

(10) Patent No.: US 11,533,958 B1
(45) Date of Patent: Dec. 27, 2022

(54) FACE MASK DEVICE

(71) Applicants: Robert Spinnato, Gardnerville, NV (US); Keely Spinnato, Gardnerville, NV (US); Angelina Spinnato, Gardnerville, NV (US)

(72) Inventors: Robert Spinnato, Gardnerville, NV (US); Keely Spinnato, Gardnerville, NV (US); Angelina Spinnato, Gardnerville, NV (US)

(73) Assignee: SKY T LLC, Gardnerville, NV (US)

( * ) Notice: Subject to any disclaimer, the term of this patent is extended or adjusted under 35 U.S.C. 154(b) by 221 days.

(21) Appl. No.: 16/907,042

(22) Filed: Jun. 19, 2020

(51) Int. Cl.
*A41D 13/11* (2006.01)
*A41D 27/00* (2006.01)

(52) U.S. Cl.
CPC ..... *A41D 13/1184* (2013.01)

(58) Field of Classification Search
CPC ..... A41D 13/1184
See application file for complete search history.

(56) References Cited

U.S. PATENT DOCUMENTS 1,279,884 A * 9/1918 Roche ..... A41D 13/1184 2/427
2,056,753 A * 10/1936 Wagner ..... A41D 13/11 D24/110.2
2,498,668 A * 2/1950 Fitzsimmons ..... A41D 13/11 D29/108
2,866,202 A * 12/1958 Landis ..... A61F 9/02 2/12
3,298,031 A * 1/1967 Morgan ..... A61F 9/029 2/427
3,310,812 A * 3/1967 Gaisser ..... A41D 13/1184 2/9
3,529,594 A * 9/1970 Charnley ..... A62B 17/006 2/457
3,768,100 A * 10/1973 Colman ..... A41D 13/1184 2/9
5,107,547 A * 4/1992 Scheu ..... A41D 13/1184 2/9
2017/0132845 A1* 5/2017 Everman, II ..... G06F 3/017
2020/0114178 A1* 4/2020 Waterford ..... A62B 23/025
2021/0361984 A1* 11/2021 Jackson ..... A62B 18/025
2022/0192286 A1* 6/2022 Spence ..... A41D 13/0512
2022/0225701 A1* 7/2022 Ritchie ..... A41D 13/1115

* cited by examiner

*Primary Examiner* — Robert H Muromoto, Jr.
(74) *Attorney, Agent, or Firm* — Theodore J. Bielen, Jr.

(57) ABSTRACT

A face mask device utilizing a flexible sheet of material having three termini. One of the termini includes an aperture that serves as an anchor place in combination with spectacles worn by the user. The two remaining termini are used to tie the mask about the head of the user.

7 Claims, 6 Drawing Sheets

FIG. 3
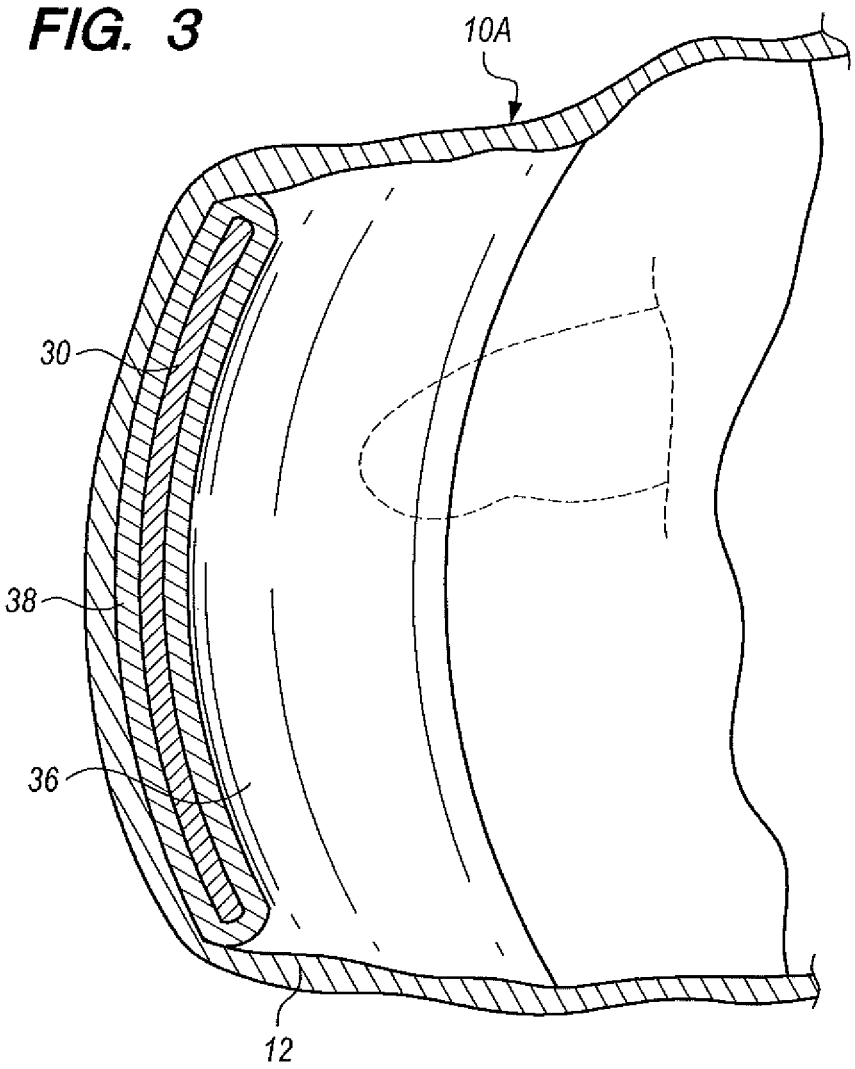
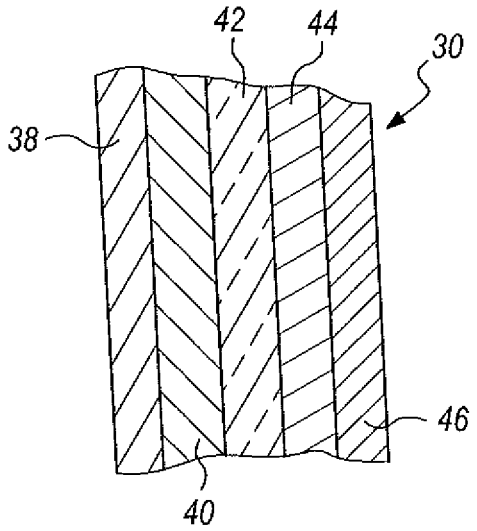
FIG. 4

FACE MASK DEVICE

BACKGROUND OF THE INVENTION

The present application relates to a novel and useful face mask device suitable for infection prevention and healthcare procedures.

Face masks or surgical masks are intended to be worn by medical personnel during hospital procedures. Face masks are designed to prevent infections emanating from patients and treating personnel by catching bacterial and viruses shed in liquid droplets and aerosols that emanate from the wearer's mouth and nose. Face masks are also employed in the general populous to attenuate spread of pandemic microbes. It should also be noted that face masks are not designed to protect the wearer from breathing in airborne microbes. In any case, it is important that a surgical mask be comfortably worn and positioned properly about the face of the user to be effective.

In the past, surgical masks in the prior art have not been easily positioned and maintained about the face of the user. This characteristic has discouraged face mask usage. A well-supported surgical mask that is comfortable to the user and maintains its position adjacent the face of the user when in place would be a notable advance in the medical arts.

SUMMARY OF THE INVENTION

In accordance with the present application, a novel and useful face mask device is herein provided.

The face mask of the present application utilizes a sheet of flexible material that includes a first side and an opposite second side. Also, the sheet of flexible material possesses a material sheet that forms a central area and three termini. The first terminus is also formed with an aperture of sufficient size to allow the passage of the central area and the second and third termini therethrough. The sheet of flexible material may be formed of any suitable fabric such as wool, cotton, nylon, polyester, vinyl, cotton, and the like. It is desirable that the mask material possess one-way wicking capability to maintain dryness and eliminate odors, when being worn.

The device of the present application also includes spectacles, which may be in the form of eyeglasses, goggles, and the like. The spectacles include at least one lens supported by a frame or support structure. The frame also possesses a portion that is adapted and intended to bridge the nose of the human anatomy.

A fastener is also employed in the present application to hold the sheet to the frame by utilizing the aperture through the first terminus of the sheet of flexible material. By doing so, the fastener orients the first side of the flexible sheet of material to lie opposite the portion of the frame intended to bridge the nose of the user.

The second and third termini of the flexible sheet are also sized and intended to extend at least partially about the head of the human anatomy. In certain cases, the second and third termini of the flexible sheet may be tied together behind the head and tucked behind the ears of the user.

A filter is also employed in the device of the present application and is positioned adjacent the first side of the sheet of flexible material when the sheet of flexible material is being worn by the user. An adhesive layer may be employed and be interposed the filter and the first side of the sheet of flexible material in order to maintain the filter in place nest to the flexible sheet. Further, the adhesive layer removably adheres the first side of the flexible sheet to the filter, to permit convenient replenishment of the same.

The fastener may also take the form of a clip which engages the aperture through the first terminus of the flexible sheet. The clip is also structured to engage the spectacles being worn by the user. In certain cases, the fastener may include an element engaging the frame of the spectacles and an elastic member connected to the sheet of material at the aperture of the first terminus. The elastic member would be joined with the engaging element to support the mask in its proper position at the frame of the spectacles. Moreover, the fastener may simply comprise a line or string connected to the frame of the spectacles and the sheet of material at the aperture through the first terminus of the sheet of flexible material.

The filter may be formed of any suitable material and include a multilayer configuration to maximize the protection afforded by the mask device of the present application.

In a certain embodiment of the device of the present application, a cord may be attached to at least the second terminus, and preferably the second and third termini, of the flexible sheet. The cord would form a loop which extends over the ear of the user of the mask. A sleeve is employed to frictionally engage at least the one cord associated with the second terminus of the flexible sheet to adjust the distance between the second terminus of the flexible sheet and the place of intended engagement of the ear of the human anatomy by the cord.

It may be apparent that a novel and useful face mask device has been described.

It is therefore an object of the present application to provide a face mask device that is usable with a set of spectacles or eyeglasses which aids in the support of a flexible sheet, which extends over the nose and mouth of the user.

It is another object of the present application to provide a face mask device which may be employed with a filter that lies adjacent the flexible material when the mask is being used by a person.

Another object of the present application is to provide a face mask device that attached to eyeglasses, goggles, and the like and holds the flexible material in an upright position, providing comfort to the user without the use of straps about the ears of the user.

Another object of the present application is to provide a face mask device that uses a sheet of flexible material that is supported by spectacles through the provision of sheet apertures and may be twisted to create a pocket to conform to the chin of the user and is able to be fastened to the user by tying the flexible material at the back of the head of the user.

Another object of the present application is to provide a face mask device that employs spectacles having nose supports that aid in the positioning of the flexible sheet of the mask of the present device.

Yet another object of the present application is to provide a face mask device that utilizes a sheet of flexible material configured to cover the nose and mouth of the wearer without obstructing the eyes of the wearer.

The application possesses other objects and advantages especially as concerns particular characteristics and features thereof which will become apparent as the specification continues.

BRIEF DESCRIPTION OF THE SEVERAL VIEWS OF THE DRAWINGS

FIG. 3 is a sectional view similar to FIG. 2 showing a different embodiment of the flexible sheet of FIG. 1.

FIG. 4 is a sectional view indicating the multilayer structure of the filter portion of the device of the present application.

For a better understanding of the application, reference is made to the following detailed description of the preferred embodiments.

DETAILED DESCRIPTION OF THE PREFERRED EMBODIMENTS

Various aspects of the present application will evolve from the following detailed description of the preferred embodiments thereof which should be references to the prior delineated drawings.

Figure 1:
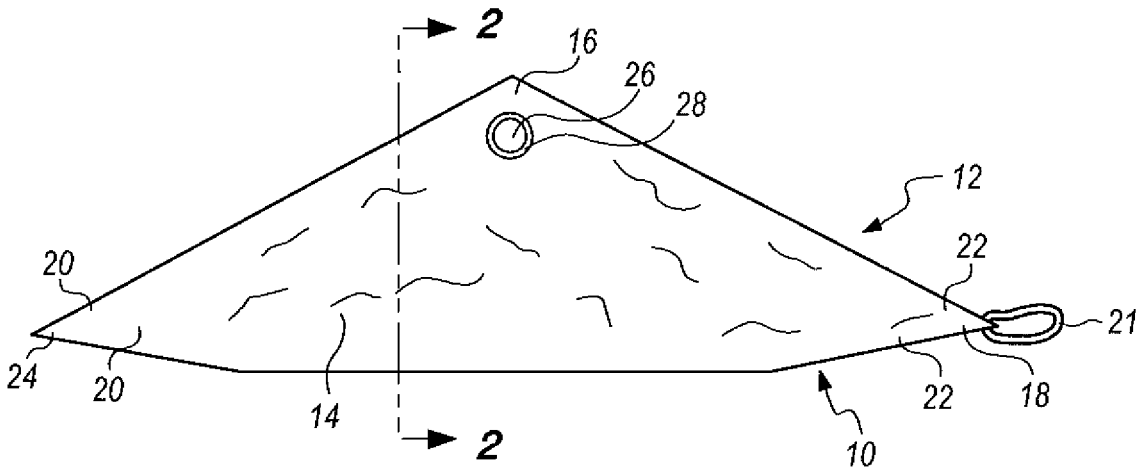
FIG. 1 is a top plan view of the flexible sheet of the device of the present application.

The invention as a whole is shown by reference character 10. Face mask 10 includes as one of its elements a flexible sheet 12. Flexible sheet 12 may be formed of any suitable fabric, such as wool, polyester, spandex, elastane, polyamide, cotton, as well as any woven, nonwoven, or electrospun material, and the like. Preferably, the material of mask 12 possesses one-way wicking capabilities to maintain dryness and eliminate odors when worn. Also, the fabric-like material of flexible sheet 12 may be translucent, such as a see through vinyl. Flexible sheet 12 is formed with a central portion 14 as well as first terminus 16, second terminus 18, and third terminus 20. The first, second, and third termini 16, 18, and 20, include relieved portions 22, 23, and 24 which tends to narrow first, second, and third termini 16, 18, and 20. A loop 21 may be selectively formed at the end of termini 18 and 20, illustrated on terminus 18 of FIG. 1. Loop 21 may serve as a hang-up place for face mask 10 or as a pull through for terminus 20. An aperture or hole 26 is formed through first terminus 16 and may include a reinforcing ring 28 that is formed of relatively rigid material, such as plastic, wood, metal, and the like.

Figure 2:
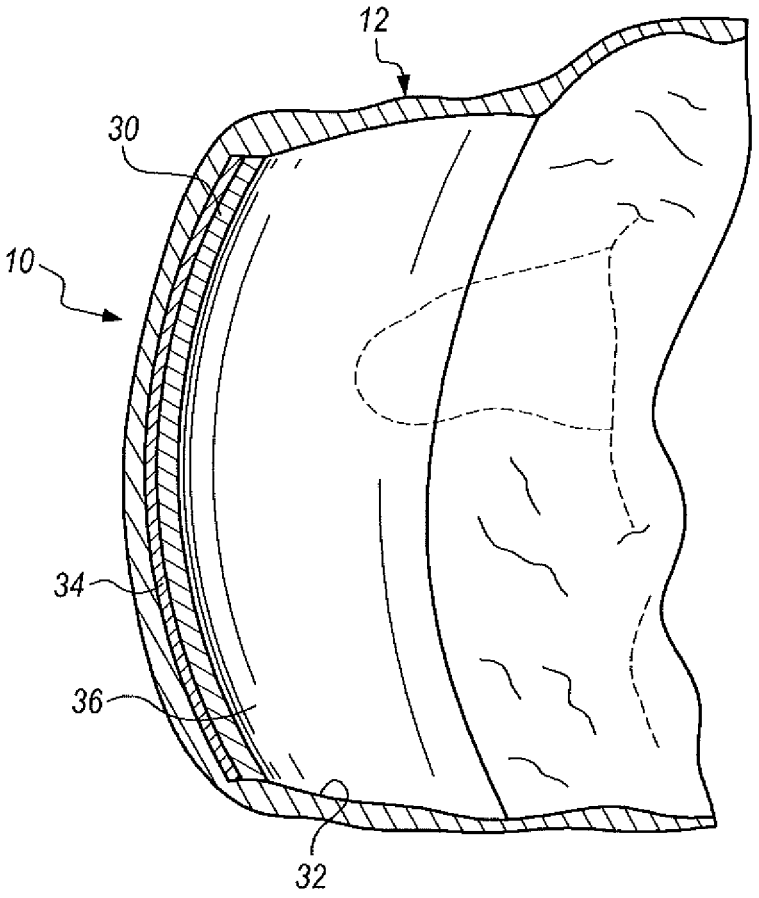
FIG. 2 is a sectional view taken along 2-2 of FIG. 1.

Referring now to FIG. 2, it may be observed that device 10 is depicted in section including flexible sheet 12 forming the outer layer. A filter 30 is also employed in device 10 and lies against the inner surface 32 of flexible sheet 12. Adhesive or mastic layer 34 holds filter 30 against inner surface 32 of flexible sheet 12. Adhesive layer 30 may have a certain grip to allow the easy removal of filter 30 for the sake of replenishment. A chamber 36 is depicted as being formed by face mask device 10, and which will be further discussed as the specification continues.

FIG. 3 depicts another embodiment of face mask device 10, indicated by reference character 10A. Device 10A includes flexible sheet 12 and filter 30. A sheath 38 encloses filter 38 within chamber 36 and provides a certain degree of isolation of filter 38 from contact with the skin of the user of mask device 10.

Filter 30 is depicted in section in FIG. 4 and may include a multiple number of plies or layers. FIG. 4 depicts filter 30 as having 5 plies, each ply possessing a specific characteristic. As illustrated in FIG. 4, ply 38 may take the form of an anti-stick cloth while ply 40 may constitute a filter cloth. Ply 42 may be formed of activated carbon while ply 44 is constructed of a filter cloth. Ply 46 may, again, be formed of anti-stick cloth. Although filter 30 is depicted as having multiple layers, a single layer could also suffice in this regard.

Figure 5:
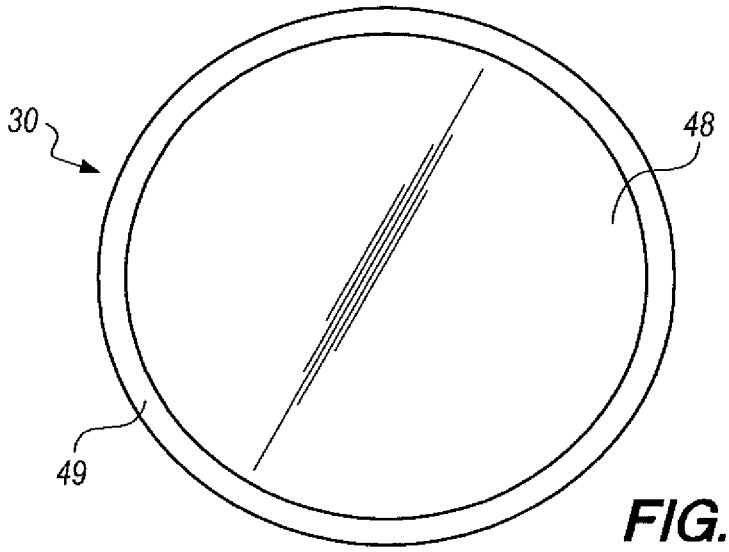
FIG. 5 is a top plan view of a filter usable in the device of the present application.
Figure 6:
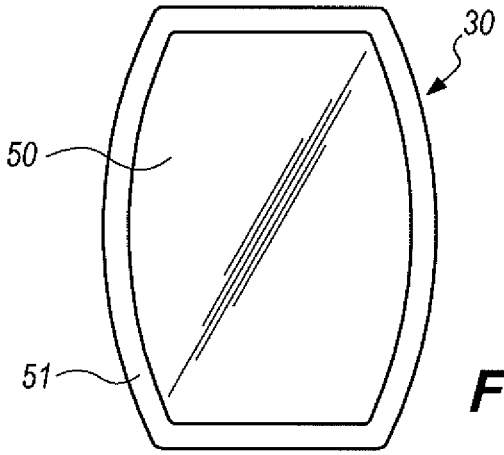
FIG. 6 is a top plan view of a filter usable with the device of the present application.
Figure 7:
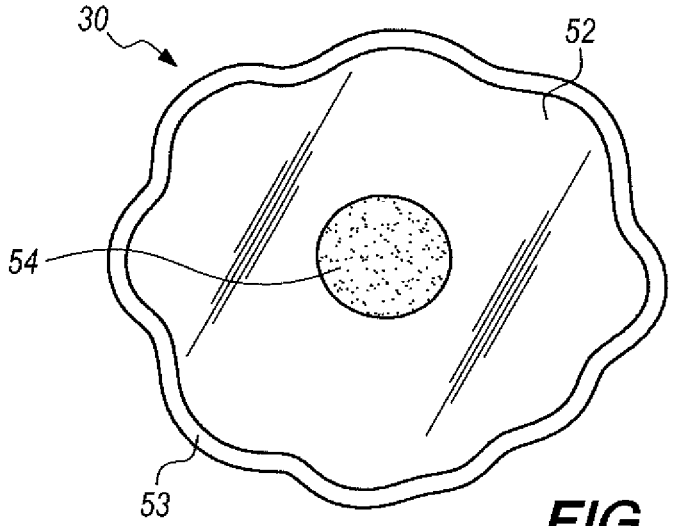
FIG. 7 is a top plan view of yet another filter usable with the device of the present application.

Filter 30 may also be formed into various shapes, as illustrated in FIGS. 5-7. For example, filter 30 may take the form of an air porous round or circular body 48, an air porous elongated body 50, or an air porous flower-shaped body 52 having padded center portion 54. Adhesive perimeters 49, 51, and 53 of circular body 48, elongated body 50, and flower-shaped body 52, respectively, permit such filters to stick to inner surface 32 of flexible sheet 12. Each perimeter may measure 1.5-2.5 centimeters across.

Figure 8:
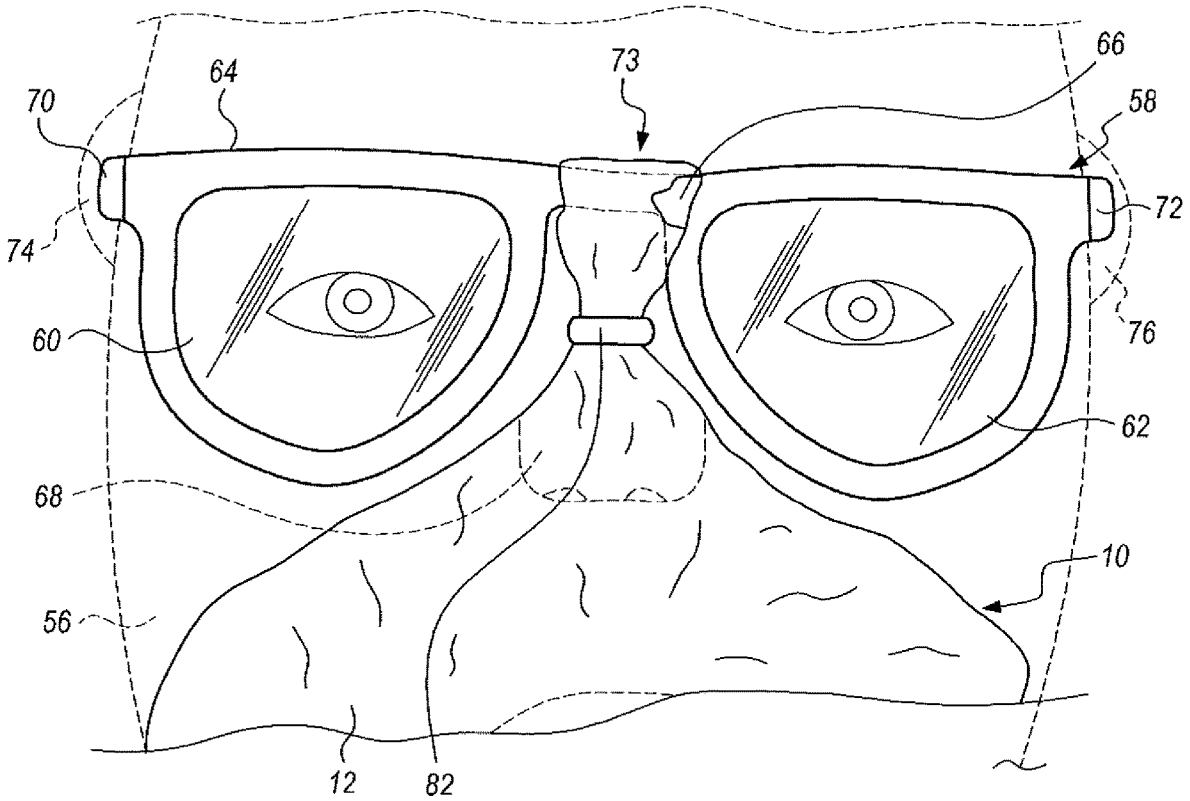
FIG. 8 is a schematic front view of the device of the present application mounted to spectacles being worn by a human.

FIG. 8 shows device 10 as being positioned relative to a human head, drawn in phantom. Device 10 also includes spectacles 58 which may take the form of eyeglasses, goggles, and the like. Spectacles 58 have lenses 60 and 62 that are held in a frame 64. Bridge portion 66 of frame 64 lies across the nose 68 (shown in phantom) and gains support therefrom. Arms or temples 70 and 72 of frame 64 extend to ears 74 and 76 (shown in phantom).

Figure 9:
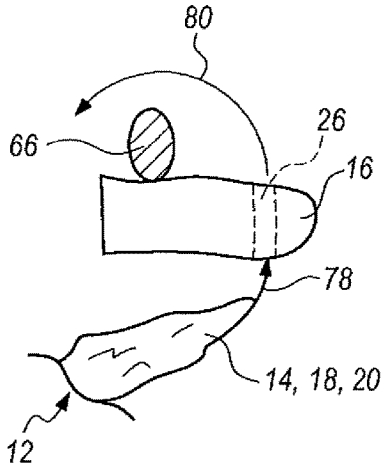
FIG. 9 is a schematic side elevational view indicating the looping of the central area, and the second and third terminus of the flexible sheet through the aperture in the first terminus.
Figure 10:
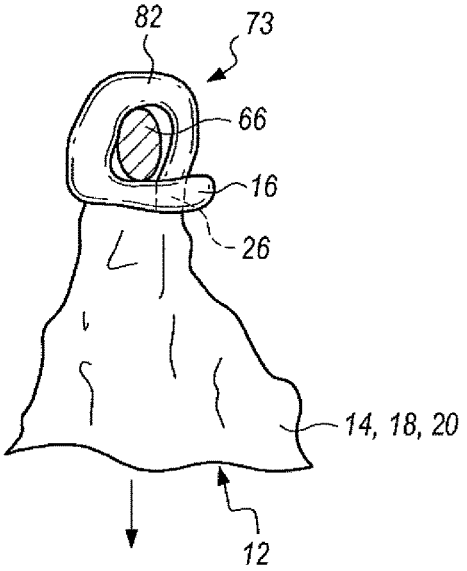
FIG. 10 is a schematic side elevational view showing portions of the flexible sheet passed through the aperture in the first terminus of the flexible sheet.

Viewing now FIGS. 9 and 10, it may be observed that flexible sheet 12 is supported by spectacles 58 by being looped over bridge 66 of frame 64. Such support is obtained by passing second terminus 18, third terminus 20, and central portion 14 of flexible sheet 12 through aperture 26 located at first terminus 16. Directional arrows 78 and 80 show this maneuver. FIG. 10 indicates that such looping has taken place by the passage of central portion 14, second terminus 18, and third terminus 20 of flexible sheet 12 through aperture 26 and over the bridge 66 of frame 64. A slipknot 82 has been formed in this regard.

Figure 11:
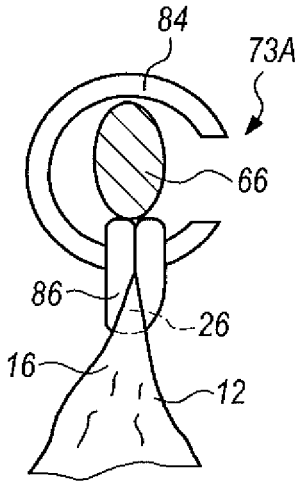
FIG. 11 is a side schematic view showing the use of an alternate embodiment of the fastener of the present device.
Figure 12:
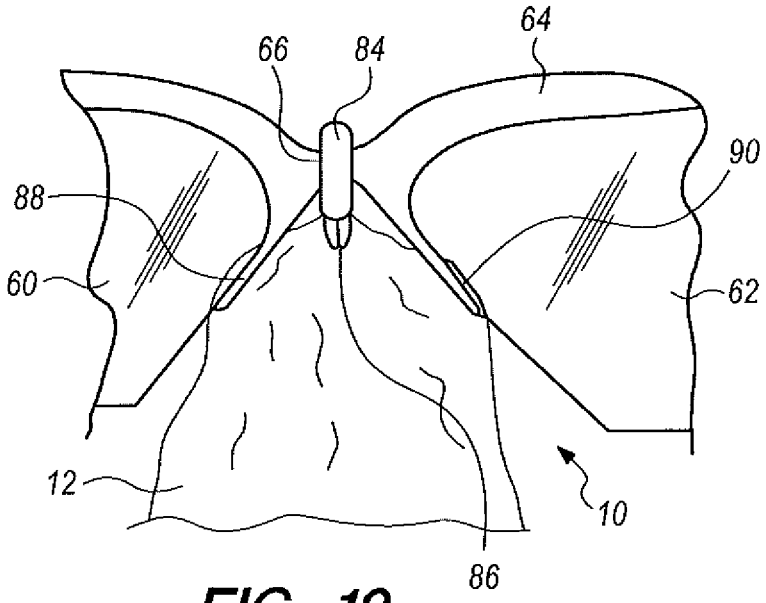
FIG. 12 is a front elevational view partially illustrating spectacles and the connection of the device of the present application utilizing the fastener shown in FIG. 11.

FIG. 11 shows an alternate fastener 73A to the slipknot fastener 73 of FIGS. 8 and 10. A C-ring element 84 lies over bridge 66 of frame 64 and is engaged by an elastic member 86 which passes through aperture 26 of first terminus 16. FIG. 12 indicates that nose rests 88 and 90 of frame 64 adds to the support of flexible sheet 12. C-ring element may also be employed to hold sheet, via aperture 26, to frame 64, without elastic member 86.

Figure 13:
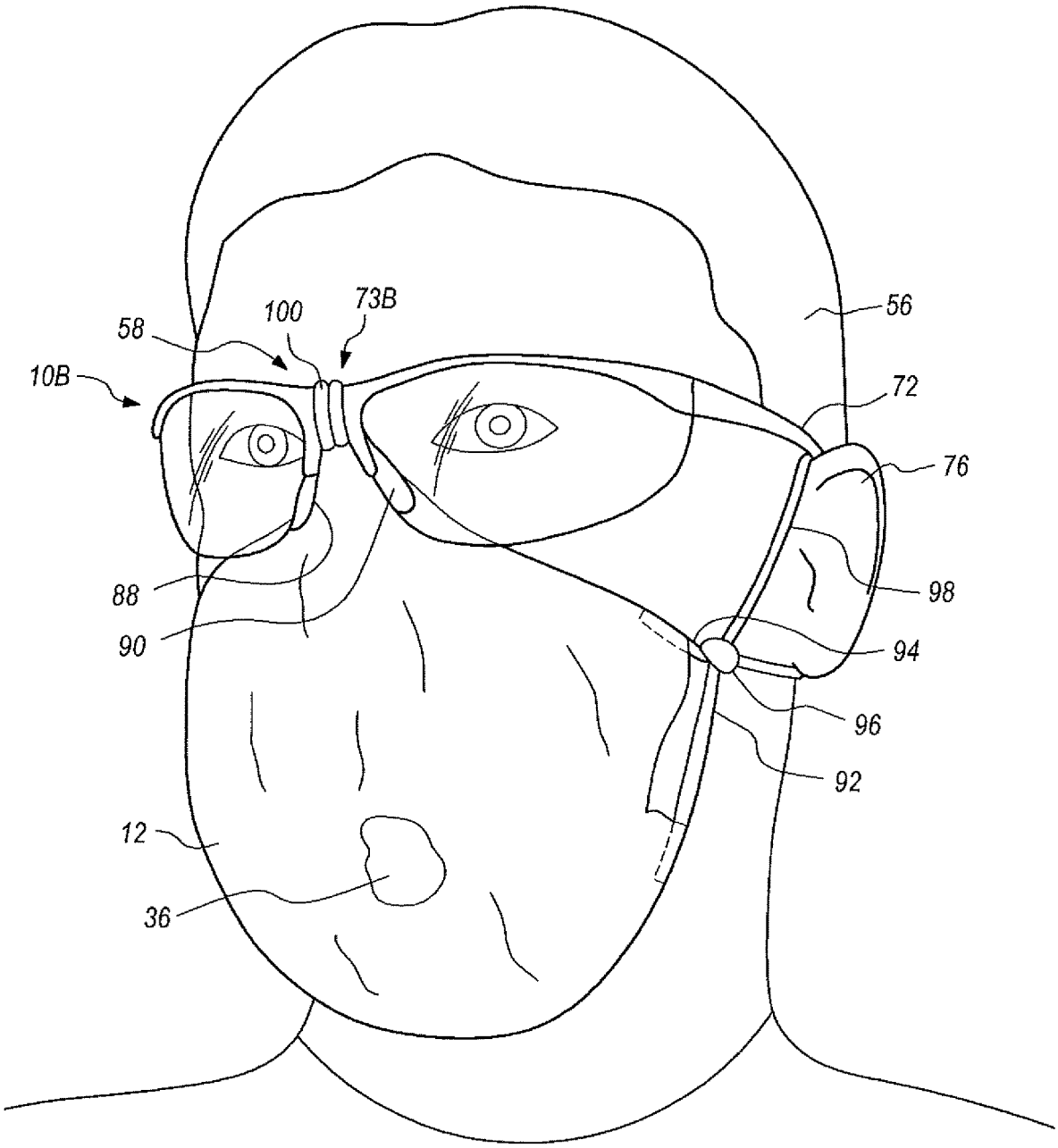
FIG. 13 is a schematic front elevational view of a human wearing the face mask device of the present application utilizing an embodiment having an adjustable cord fitting around the ears of the human.

FIG. 13 shows yet another embodiment 10B of the device of the present application. Flexible sheet 12 connects to cords 92 and 94. Cords 92 and 94 may extend along the perimeter of sheet 12 to add further support to the flexible sheet 12. In this regard, cords 92 and 94 may also be elastomeric in nature. A sleeve 96 slidingly engages cords 92 and 94 and serves to adjust the tightness of flexible sheet 12 against the head 56 of the user of device 10B. Cords 92 and 94 also form a loop 98 that fits over ear 76 of the user. A line or string 100 passes through aperture 26 of flexible sheet 12 and ties around the bridge 66 of frame 94 to hold flexible sheet in place, serving as fastener 73B.

In operation, the user attaches flexible sheet 12, including filter 30, shown in either FIG. 2 or 3, to the bridge 66 of frame 64 through fastener 73. Fastener 73 may be fashioned by the formation of slipknot 82 by the passing of central portion 14, second terminus 18, and third terminus 20 of flexible sheet 12 through aperture 26 found at first terminus 16 of sheet 12. Such formation is illustrated by FIGS. 9 and 10. Alternatively, flexible sheet 12 may be attached to bridge 66 of frame 64 by the use of fastener 73A having C-ring 84 and elastic member 86, FIGS. 11 and 12, or by the fastener 73B consisting of tie line 100, shown in FIG. 13. In any instance, aperture 26, found on first terminus of flexible sheet 12, is employed. Termini 18 and 20 are then knotted behind head 56 and may be passed over ears 74 and 76. Central portion 14 of sheet 12 covers the nose and mouth of the wearer without obstructing the eyes of the user. With respect to embodiment 10B of FIG. 13, additional support is obtained by the tightening of cords 92 and 94 through the use of sleeve 96. In any case, mask device 10 is comfortably and positively supported to the user. Chamber 36, FIG. 13, is sealed since the top of mask device 10 is tensioned and the bottom of mask device 10 is pulled upwardly. Nose rests 88 and 90 add to the formed seal. Moreover, flexible sheet 120 may be retained to spectacles 58 when spectacles 58 are removed from the user's head 56.

While in the foregoing embodiments of the application have been set forth in considerable detail for the purposes of making a complete disclosure of the invention it may be apparent to those of skill in the art that numerous changes may be made in such details without departing from the spirit and principles of the invention.

What is claimed is:

1. A face mask device intended to cover a portion of a human anatomy, including a head, a nose, a mouth, and a pair of ears, comprising:

a sheet of flexible material, said sheet possessing a first side and a second side, a perimeter forming a central area, and first, second, and third termini, said first terminus of said flexible sheet including an aperture therethrough;

spectacles, said spectacles comprising at least one lens supported by a frame, said frame including a portion adapted and intended to bridge the nose of the human anatomy, and a pair of arms extending to the pair of ears;

a fastener, said fastener holding said sheet of flexible material to said frame for support therefrom, said fastener comprising a slipknot formed by passage of said second terminus, said third terminus, and said central portion of said flexible sheet through said aperture at said first terminus of said flexible sheet and over said portion of said frame intended to bridge the nose of the human anatomy, said fastener further orienting the first side of said flexible sheet of material to lie opposite said portion of said frame adapted and intended to bridge the nose of the human anatomy; and said second and third termini of said flexible sheet being sized and intended to extend about the head of the human anatomy.

2. The device of claim 1 which additionally comprises a filter, said filter positioned adjacent said first side of said sheet of flexible material.

3. The device of claim 2 which further comprises an adhesive layer interposed said filter and said first side of said sheet of flexible material.

4. The device of claim 3 in which said adhesive layer is adapted to adhere to said first side of said flexible sheet.

5. The device of claim 2 in which said filter comprises a multilayer entity.

6. The device of claim 1 which additionally comprises a first cord connected to said second terminus of said flexible sheet and a second cord connected to said third terminus of said flexible sheet, said first cord intended to engage an ear of the human anatomy.

7. The device of claim 6 which additionally comprises a sleeve frictionally engaging at least said first cord to adjust the length of a portion of said first cord intermediate said second terminus of said flexible sheet and the intended engagement of an ear of the human anatomy.

* * * * *